US008157422B2

(12) United States Patent
Paik et al.

(10) Patent No.: US 8,157,422 B2
(45) Date of Patent: Apr. 17, 2012

(54) LIGHTING APPARATUS

(75) Inventors: Dongki Paik, Changwon-si (KR); Hyunha Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/049,771

(22) Filed: Mar. 16, 2011

(65) Prior Publication Data

US 2011/0317428 A1 Dec. 29, 2011

(30) Foreign Application Priority Data

Jun. 24, 2010 (KR) ..... 10-2010-0060168

(51) Int. Cl.
*F21V 29/00* (2006.01)

(52) U.S. Cl. ..... 362/294; 362/373; 362/646; 362/640; 362/249.02; 362/800

(58) Field of Classification Search ..... 362/651, 362/652, 373, 294, 249.02, 249.11, 800
See application file for complete search history.

(56) References Cited

U.S. PATENT DOCUMENTS 7,628,513 B2 * 12/2009 Chiu ..... 362/311.02
7,670,028 B2 * 3/2010 Liu et al. ..... 362/294
7,677,767 B2 * 3/2010 Chyn ..... 362/294
7,874,710 B2 * 1/2011 Tsai et al. ..... 362/373
7,922,364 B2 * 4/2011 Tessnow et al. ..... 362/294

* cited by examiner

*Primary Examiner* — Anabel Ton
(74) *Attorney, Agent, or Firm* — KED & Associates, LLP

(57) ABSTRACT

A lighting apparatus is disclosed herein that may illuminate a space with light emitted from a light source or to concentrate the emitted light on a certain object. The lighting apparatus may include a lens and a main body that may house a light source. One or more connectors may be formed on the lens and the main body to connect the lens to the main body such that the connectors are not visible once the lighting apparatus is assembled. The lighting apparatus may facilitate mass production and enhance design characteristics owing to a simplified coupling configuration of the connectors provided therein.

11 Claims, 11 Drawing Sheets

LIGHTING APPARATUS

CROSS-REFERENCE TO RELATED APPLICATION(S)

Pursuant to 35 U.S.C. §119(a), this application claims the benefit of earlier filing date and right of priority to Korean Patent Application No. 10-2010-0060168, filed in Korea on Jun. 24, 2010, the contents of which are hereby incorporated by reference herein in their entirety.

BACKGROUND

1. Field

A lighting apparatus is disclosed herein.

2. Background

Lighting apparatuses are known. However, they suffer from various disadvantages.

BRIEF DESCRIPTION OF THE DRAWINGS

The embodiments will be described in detail with reference to the following drawings in which like reference numerals refer to like elements, and wherein.

DETAILED DESCRIPTION

Figure 1:
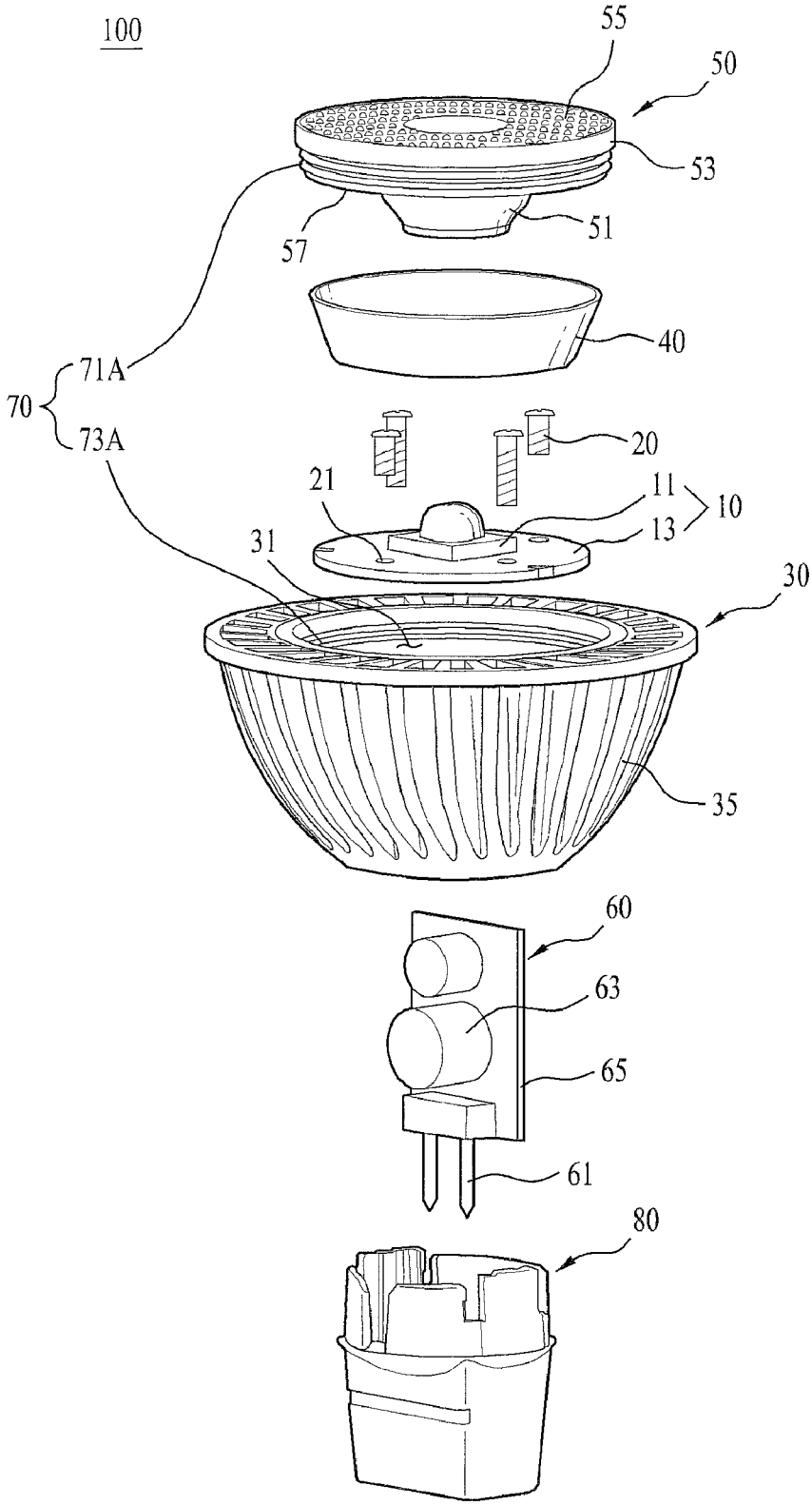
FIG. 1 is an exploded perspective view of a lighting apparatus according to an embodiment of the present disclosure.

In the following detailed description, reference is made to the accompanying drawing figures which form a part hereof, and which show by way of illustration specific embodiments of the invention. It is to be understood by those of ordinary skill in this technological field that other embodiments may be utilized, and structural, electrical, as well as procedural changes may be made without departing from the scope of the present invention. Wherever possible, the same reference numbers will be used throughout the drawings to refer to the same or similar parts.

The present application or patent relates to a lighting apparatus that illuminates a space with light emitted from a light source or to concentrate the light on a certain object. The lighting apparatus may include a lens and a main body that may house a light source. One or more connectors may be formed on the lens and the main body to connect the lens to the main body such that the connectors are not visible once the lighting apparatus is assembled. More particularly, the present application or patent relates to a lighting apparatus that may facilitate mass production and enhance design characteristics owing to a simplified coupling configuration.

Various types of lighting apparatuses, such as incandescent lights, fluorescent lights, halogen lamps, etc., may be used for illumination. Lightning apparatuses that employ light-emitting diodes (LED) as a light source may be used in place of filament type lights, fluorescent bulbs, halogen lamps, etc. That is, LEDs may be used as a general lighting apparatus for use in homes or offices.

LEDs may be designed to emit light via re-coupling of minority carriers (electrons or holes) formed at p-n junctions of semiconductors. Such LEDs may have a smaller size and longer lifespan than conventional light sources and may exhibit high illumination efficiency with lower power consumption by directly converting electrical energy into light. LEDs may also have a rapid response time, thus allowing for application as, for example, display devices in vehicles, light sources in optical communication appliances, and lamps or display devices in a variety of electronic appliances.

Examples of lighting apparatuses which may use LEDs as a light source include an LED street lamp, a bulb type LED lamp, a bar type LED lamp, a tube type LED lamp, a downlight type LED lamp, a flat panel display device, an LED sign channel module, or the like. All such lighting apparatuses are collectively referred to herein as an LED lighting device or LED lighting apparatus.

The LED lighting apparatus may include a lens that condenses light emitted from an LED to guide the condensed light towards a desired region. Also, since the operational performance of the LED lighting apparatus may greatly depend on its surroundings, to allow rapid dissipation of heat generated during operation of the LED, the LED may often be mounted in a heat sink or heat-dissipating member. For example, a main body of the LED lighting apparatus may be configured as a heat sink to dissipate heat generated by the LEDs mounted therein.

To assemble the lens in the heat sink, the lens may be fastened to the heat sink by fastening elements, such as bolts. However, the bolt assembly may make it difficult to reduce production costs of the LED lighting apparatus due to an increase in the number of constituent elements and may also have a negative effect on productivity. In addition, deterioration in aesthetics may be inevitable because the fastening elements, such as bolts, may be visible from the outside.

A lighting apparatus according to the present application or patent may be applicable to all types of lighting apparatuses. For example, the lighting apparatus according to the present application or patent may be applicable to lamps including a street lamp, bar type lamp, tube type map, downlight type lamp, light source for flat panel displays, light source for signboards, indoor/outdoor lights, or another appropriate type of a light source. Hereinafter, simply for ease of explanation, a lamp type lighting apparatus of the above mentioned various lighting apparatuses will be described by way of example.

FIG. 1 is an exploded perspective view of the lighting apparatus according to an embodiment of the present disclosure. As illustrated in FIG. 1, the lighting apparatus 100 according to this embodiment may include a light source module 10 having a light-emitting element 11, a main body 30 having a cavity 31 (recess) in which the light source module 10 may be placed and which may serve as a heat sink for the light-emitting element 11, a lens 50 placed in the cavity 31 of the main body 30, and fastening structures 71A and 73A integrally formed at the lens 50 and the main body 30, respectively, to couple the lens unit 50 to the main body 30.

Here, the light-emitting element 11 may be an LED. Simply for ease of explanation, the light-emitting element 11 is disclosed herein as an LED. However, the light-emitting element 11 is not limited thereto, and may be another appropriate type of device that emits light. The light source module 10 may include at least one LED 11 and a substrate 13 on which the LED 11 may be mounted. The substrate 13 may be a circuit board, for example, a printed circuit board (PCB). Simply for ease of explanation, the substrate 13 is disclosed herein as a PCB, however, another appropriate type of substrate may be provided. Here, the PCB 13 may have at least one through-hole 21 through which at least one fixing element 20 (connector) may be inserted to fasten the light source module 10 to the heat sink 30. The fixing element 20, as illustrated in FIG. 1, may be a bolt, screw, rivet, or another appropriate type of connector.

Figure 3A:
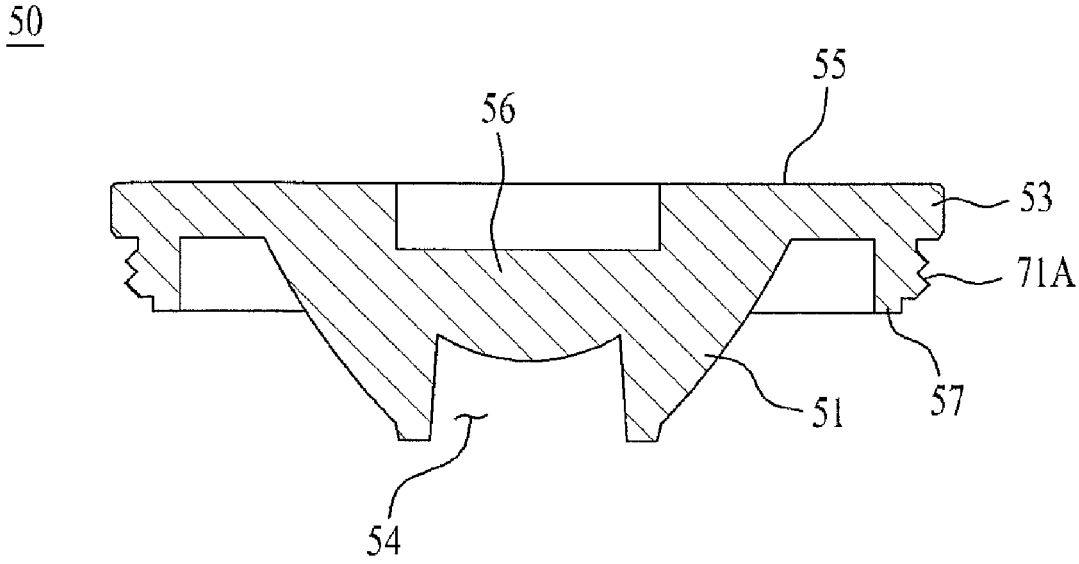
FIGS. 3A and 3B are side sectional view of a lens and a heat sink of the lighting apparatus, respectively, according to an embodiment of the present disclosure.
Figure 3B:
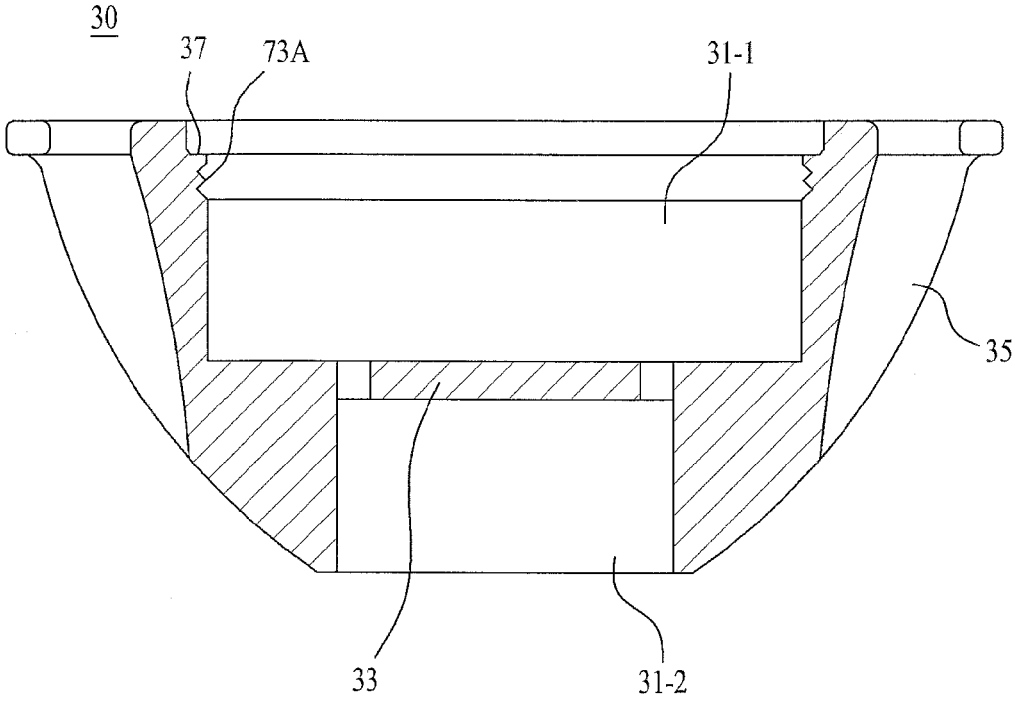

The main body 30 may include a seating plane 33 (mounting plate) which may divide the cavity 31 into an upper region 31-1 (upper cavity) and a lower region 31-2 (lower cavity) (see FIG. 3B). Once the light source module 10 is positioned on the seating plane or divider 33 of the main body 30, the fixing element 20 may be inserted through the through-hole 21 on the light source module 10 and a through-hole on the seating plane 33 to fasten the light source module 10 to the main body 30. In certain embodiments, the through hole on the seating plane 33 may be provided with threads to mate with the fixing element 20. Accordingly, the light source module 10 may be coupled to the main body.

In an alternative embodiment, the light source module 10 may be connected to the seating plane 33 without fixing element 20. For example, once the light source module 10 is positioned on seating plane 33, a reflector 40 and lens 50 positioned on the light source module 10. The reflector 40 and lens 50, when assembled on the main body 30, may be configured to hold the light source module 10 in place such that additional fixing elements 20 are not needed.

In this alternative embodiment, the substrate 13 of the light source module 10 may be formed to match a width of cavity 30 of the main body 30, thereby preventing lateral movement. The reflector 40 and lens 50 may be configured to touch the substrate 13 when inserted into the cavity 30, thereby preventing vertical movement. Hence, the light source module 10 may be mounted to the main body 30 without fixing element 20.

The light source module 10 may be positioned in the upper region 31-1 of the cavity 31 of the heat sink body 30, thereby serving to emit light from the upper side of the main body 30. In this embodiment, the main body 30 may be configured as a heat sink to dissipate heat generated by the LED 11 of the light source module 10 to the atmosphere. For example, the light source module 10 may be thermally coupled to the main body 30. In certain embodiments, a thermally conductive pad, a heat sink compound, or another appropriate type of thermal conductors may be provided between the seating plane 33 and the light source module 10 to enhance heat transfer. Moreover, the main body 30 may be formed of a thermally conductive material and provided with a plurality of radiator fins.

Although the main body 30 is illustrated in FIG. 1 to have a circular transversal cross-section which may increase in diameter from the bottom to the top of the main body 30, the main body 30 of the present disclosure is not limited to this shape. For example, the main body 30 may be formed to have a tubular shape or rectangular transversal cross-section. The cavity 31 of the main body 30 may be configured to receive, not only the light source module 10, but also an electric unit 60 (electric control module) and a base 80, as described in further detail hereinafter.

Moreover, the light source module 10 may be kept stationary on the seating plane 33 of the main body 30 that divides the cavity 31 into the upper region 31-1 and the lower region 31-2 in various ways, as described in further detail hereinbelow.

The main body or heat sink 30 may be made of a metal material so as to rapidly conduct and dissipate heat emitted from the light-emitting element 11. For example, the heat sink 30 may be made of a light weight metal, such as aluminum, to prevent an increase in the weight of the lighting apparatus 100. Alternatively, the heat sink 30 may be made of a thermally conductive plastic material or another appropriate type of thermally conductive material.

The heat sink 30 may include a plurality of radiator fins 35 at an outer surface thereof. The radiator fins 35 may be spaced apart from one another by a predetermined distance. The radiator fins 35 may extend vertically along a side surface of the heat sink 30. The radiator fins 35 may also be configured to extend to the top surface of the heat sink 30. Moreover, the top surface of the heat sink 30 may include a plurality of holes or openings that correspond to the area between the radiator fins 35 such that airflow around the radiator fins 35 may be increased.

The plurality of radiator fins 35 may effectively increase a surface area of the heat sink 30. The resulting increase in contact area between the heat sink 30 and air improves heat dissipation characteristics of the heat sink 30. Further, arranging the radiator fins 35 at a predetermined interval may allow air to easily move between the respective neighboring radiator fins 35, resulting in an enhancement in heat dissipation performance.

The lens 50 according to the present disclosure may be placed in the cavity 31 of the heat sink 30. The lens 50 may be configured to collect light emitted from the LED 11 of the light source module 10 and direct the collected light in a specific direction. Specifically, the lens 50 may be located above the light source module 10 in the upper region 31-1 of the cavity 31 of the heat sink 30. The lens 50 of the present embodiment may include a condenser lens 51, a flange portion 53, a light exit portion 55 (light projection surface), and a connector guide 57. The lens 50 is described in further detail hereinafter with reference to FIGS. 2 to 5.

The lighting apparatus 100 according to the present application or patent may further include a reflector 40 that may reflect light emitted from the light source module 10 in a predetermined direction. The reflector 40 may be provided between the light source module 10 and the lens 50. The reflector 40 may reflect a portion of light emitted from the LED 11 toward the lens 50. The reflector 40 may also expand an angular range of the light projected through the lens 50.

The lighting apparatus 100 according to the present disclosure may further include the electric unit 60 that drives and controls the light source module 10 upon receiving power from an external source. The electric unit 60 may be provided in a lower region of the main body 30, for example, in the lower region 31-2 of the cavity 31 of the main body 30.

The electric unit 60 may include a power connector 61 that receives power from the external source, a control element 63 that controls supply of power from the power connector 61 to the light source module 10 as well as the operation of the LED 11, and a control substrate 65 on which the power connector 61 and the control element 63 may be mounted. Here, the control element 63, and the control substrate 65 on which the control element 63 is mounted, may be located in the main body 30 such that it may be shielded from the outside. On the other hand, the power connector 61 may be exposed to the outside of the main body 30 to allow connection with the external source.

The lighting apparatus 100 according to the present disclosure may further include a base 80. The base 80 may be located underneath the main body 30 and configured to house the electric unit 60. The base 80, including the electric unit 60 fixed therein, may be inserted into the main body 30. The base 80 may prevent heat transferred from the LED 11 to the heat sink 30 from being directly transferred to the electric unit 60. That is, the base 80 may thermally insulate the electric unit 60 from the heat sink 30.

The base 80 may be connected to the main body 30 to extend outward (downward) therefrom. For example, an upper section of the base 80 may be fitted into the lower cavity 31-2 of the heat sink 30 and a lower section of the base 80 may extend away from the heat sink 30 to be exposed. As a portion of base 80 may be positioned outside the lower cavity 31-2 of the heat sink 30, the electric components housed therein may be protected from the heat generated by the LEDs 11. Moreover, a power connector hole may be provided at the bottom of the base 80 to expose the power connector 61 of the electric unit 60 to the outside.

Figure 2:
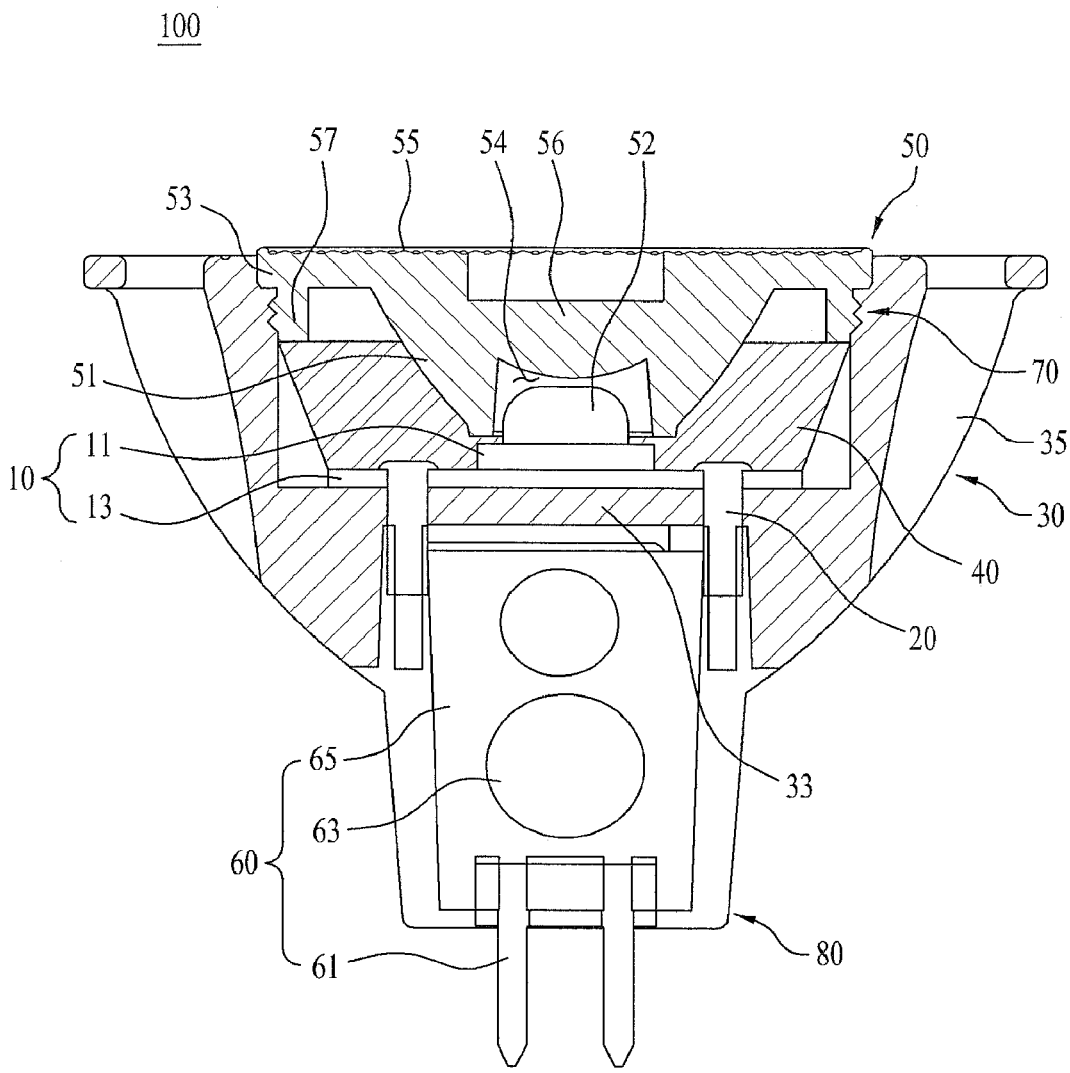
FIG. 2 is a side sectional view of the lighting apparatus according to an embodiment of the present disclosure.

FIG. 2 is a side sectional view of the lighting apparatus according to an embodiment of the present disclosure. As illustrated in FIG. 2, a light source module 10 may be mounted on a seating plane 33 that may be formed in a heat sink 30 to divide a cavity 31 in the heat sink 30 into an upper and lower regions 31-1, 31-2. The light source module 10 may be securely held in place on the seating plane 33 by a fixing element 20. The fixing element 20 may be a bolt that may be inserted through the through-hole 21 on the light source 10 and the through-hole on the seating plane surface 33 to secure the light source module 10. In certain embodiments, a reflector 40 and a lens 50 may be configured to securely hold the light source 10 in its place instead of the fixing element 20.

An upper section of a base 80 may be inserted into the lower cavity 31-2 of the main body configured as a heat sink 30 and attached thereto. By interposing the base 80 between the electric unit 60 and the heat sink 30, the electric unit 60 may be thermally and electrically insulated from the heat sink 30. Moreover, the lens 50 may be configured to capture and redirect light emitted from an LED 11 of the light source 10. The lens 50 may include a condenser lens 51 to capture most of the light emitted from the LED 11. A reflecting surface of the condenser lens 51 may have various shapes including, for example, conical, parabolic, elliptic, hyperbolic, or another appropriate shape.

Referring to FIG. 2, the condenser lens 51 may condense light emitted from the LED 11 and direct the condensed light out of the lens 50 through the light projection surface 55. A portion of the light emitted from the LED 11 may pass through a primary optical element 52 into a first cavity 54 defined in the condenser lens 51. Then, the light may pass through a central lens 56 positioned immediately above the first cavity 54 and through the light projection surface 55 to be directed to the outside.

Any remaining light that fails to pass through the central lens 56 may be refracted inside the body of the condenser lens 51. The refracted light in the condenser lens 51 may be reflected back by an outer reflecting surface of the condenser lens 51. The outer reflecting surface of the condenser lens 51 may have a parabolic conical cross-section and may be positioned inside the cavity 31 of the heat sink 30, as shown in FIG. 2. As the reflected light moves through the body of the lens 50 it may be directed towards the light exit portion 55 to be projected from the lighting apparatus 100.

The lens 50 may include a flange portion 53 by which the lens 50 is seated in the heat sink 30, and a connector guide portion 57 (fastening guide portion) provided at a lower end of the flange portion 53. The connector guide portion may assist in coupling the lens 50 to the heat sink 30. Moreover, the LED lighting apparatus 100 according to this embodiment of the present disclosure may include the fastening structures or connectors 70 formed at the connector guide portion 57 and the heat sink 30, as described in further detail hereinbelow with reference to FIGS. 3 to 5.

FIGS. 3A and 3B are side sectional views of the lens 50 and the heat sink 30 of the lighting apparatus 100 according to an embodiment of the present disclosure. More particularly, FIG. 3A is a side sectional view of the lens 50 and FIG. 3B is a side sectional view of the heat sink 30 according to an embodiment of the present disclosure.

As illustrated in FIGS. 3A and 3B, the lighting apparatus 100 according to this embodiment may include fastening structures or connectors 71A and 73A. Connectors 71A and 73A may be integrally formed at the lens 50 and the heat sink 30, respectively, to couple the lens 50 to the heat sink 30. For example, the connectors 71A and 73A may be screw threads formed at predescribed positions of the lens 50 and the heat sink 30. By providing the lens 50 and the heat sink 30 with the screw threads, the lens 50 and the heat sink 30 may be easily coupled to each other without using additional or externally visible fastening elements, such as bolts.

As illustrated in FIG. 3A, the lens 50 according to this embodiment of the present disclosure may include a condenser lens 51, a flange 53 provided at an upper end of the condenser lens 51, a light projection surface 55 provided at an upper end of the flange 53, and a connector guide portion 57 provided between the lower end of the flange 53 and the heat sink 30. As described above, the condenser lens 51 may capture light emitted from the light source 10 and direct the captured light through the light projection surface 55. The flange 53 provided at the upper end of the condenser lens 51 may hold the lens 50 in the heat sink 30. For example, the flange 53 may be seated and supported on a stepped portion 37 formed inside cavity 31 of the heat sink 30, as illustrated in FIG. 3B.

The connector guide portion 57 may serve to assist coupling the lens 50 to the heat sink 30, and may be provided at the lower end of the flange portion 53. The connector guide portion 57 may be tapered at a distal end to aid in aligning the lens 50 to the heat sink 30. Here, the connector guide portion 57 may be integrally formed with the flange 53.

For example, the connector guide portion 57 may be formed at a position inwardly spaced from a lower circumferential edge of the flange 53 by a predetermined distance, and may protrude downward from the lower surface of the flange 53 by a predetermined length. Also, the connector guide portion 57 may take the form of a circular strip that may extend around the outer circumference of the lens 50 on the flange 53, as shown in FIG. 1. However, the present disclosure is not limited to the above described shape. In certain embodiments, a plurality of connectors guides may be provided which are spaced apart from one another by a predetermined distance in the circumferential direction of the flange 53.

When the lens 50 is inserted into the cavity 31 of the heat sink 30, the connector guide portion 57 may be brought into contact with an inner wall surface of the heat sink 30 immediately below the stepped portion 37. The lens 50 may thus be configured to be aligned and guided into its proper mating position. The connector guide portion 57 may be formed integrally on the flange 53 and positioned to extend downward from a bottom surface of the flange 53.

Referring to FIG. 3B, the heat sink 30 may be provided with a plurality of radiator fins 35 on an external surface of the heat sink 30. The radiator fins 35 may be formed to protrude from the external surface of the heat sink 30 and formed to extend vertically along the side surface. The radiator fins 35 may also be spaced apart from one another and may be internally perforated from within the cavity 31. For example, each radiator fin 35 may be hollow to allow heat from inside the cavity fill the radiator fin 35, to increase heat dissipation. The cavity 31 may be formed with the seating plane or dividing wall 33 to divide the cavity 31 into an upper region 31-1 (upper cavity) and a lower region 31-2 (lower cavity).

The stepped portion 37 in the heat sink 30 may be configured to mate to the flange 53 of the lens 50. The stepped portion 37 may support the flange 53 of the lens 50 and may be formed at a predetermined distance below the open upper end of the heat sink 30. Moreover, the fastening structures 71A and 73A may be formed at predescribed positions on the connector guide portion 57 of the lens 50 and the heat sink 30 to correspond to each other.

In the embodiment as illustrated in FIGS. 3A and 3B, the fastening structures 71A and 73A may be fastening threads formed at an outer circumferential surface of the connector guide portion 57 and an inner circumferential surface of the cavity 31 of the heat sink 30. The fastening threads 71A and 73A may include a first fastening thread 71A integrally formed on the lens 50 and a second fastening thread 73A integrally formed at the heat sink 30 so as to mesh with the first fastening threads 71A to couple the lens 50 to the heat sink 30. For example, the first fastening structure 71A may include screw threads formed on the outer circumferential surface of the connector guide portion 57, and the second fastening structure 73A may include screw threads formed on the inner circumferential surface of the cavity 31 of the heat sink 30 below the stepped portion 37. The first fastening threads 71A and the second fastening threads 73A may be positioned to correspond to each other. Specifically, the first and second fastening threads 71A and 73A may be configured to accurately mesh with each other starting from a position where a lower end of the first fastening structure 71A comes into contact with an upper end of the second fastening structure 73A. The lens 50 may be rotated until the flange 53 of the lens 50 is completely seated on the stepped portion 37 of the heat sink 30. Accordingly, the fastening structures 71A and 73A may be integrally formed at the lens 50 and the heat sink 30 to mechanically couple the lens 50 to the heat sink 30.

Figure 4:
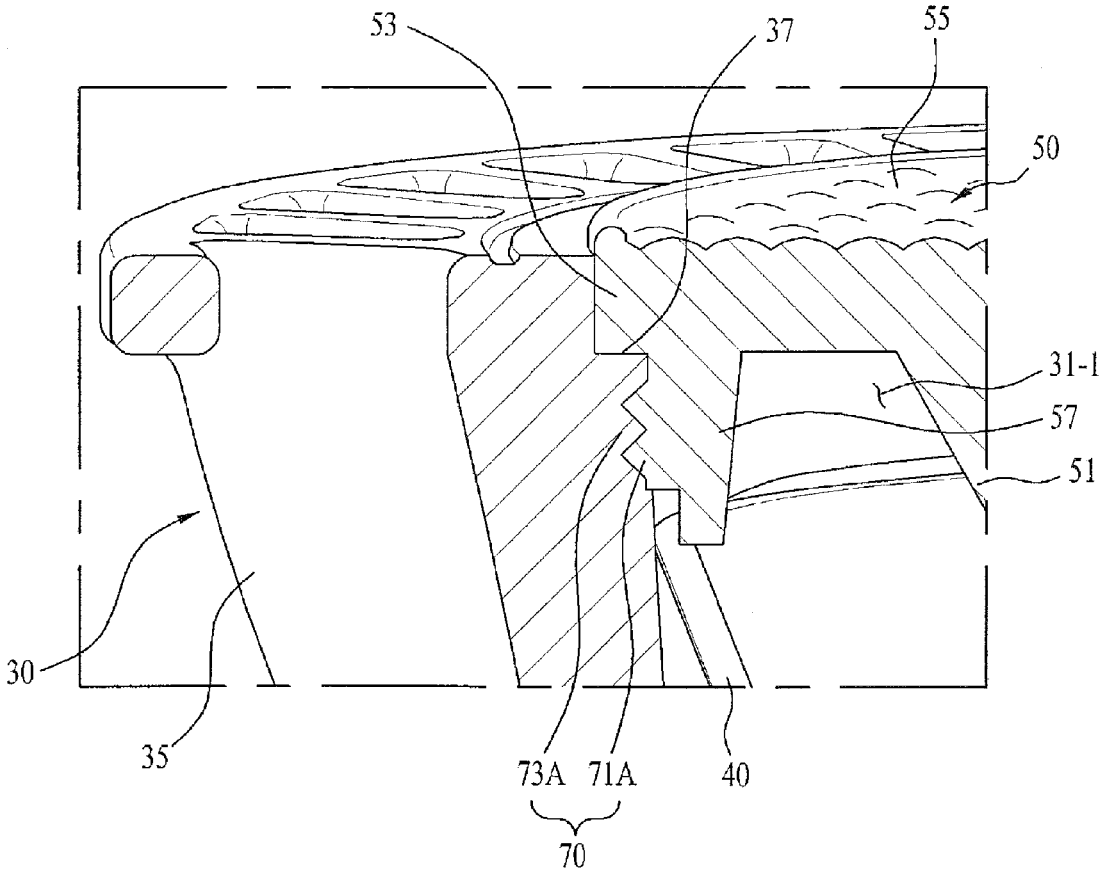
FIG. 4 is an enlarged sectional view of the lens and the heat sink of the lighting apparatus according to an embodiment of the present disclosure.

FIG. 4 is an enlarged sectional view of a lens and a heat sink of a lighting apparatus according to an embodiment of the present disclosure. FIG. 4 illustrates a reflector 40 (reflection member) in addition to the lens 50 and the heat sink 30. Referring to FIG. 4, a first fastening thread 71A formed at the connector guide portion 57 of the lens 50 may be screwed into a second fastening thread 73A formed in the upper region 31-1 of the cavity 31 of the heat sink 30 to fix the lens 50 to the heat sink 30.

The fastening threads 70 may be screwed starting from a position where the lower end of the first fastening thread 71A meshes with the upper end of the second fastening thread 73A until the flange 53 of the lens 50 is completely seated on the stepped portion 37 of the heat sink 30. Alternatively, the lens 50 may be screwed into the heat sink 30 until a lower end of the connector guide portion 57 of the lens 50 comes into contact with the reflector 40. For example, the flange 53 and the stepped portion 37 may serve as limiters or stoppers to complete the coupling between the lens 50 and the heat sink 30. In certain embodiments, the connector guide portion 57 and the reflector 40 may be limiters to limit insertion of the lens 50 into the heat sink 30. For example, the insertion of the lens 50 may be limited when the connector guide portion 57 contact a surface of the reflector 40.

As described above, by providing the fastening structures 70 according to the present disclosure such that the screw threads may be integrally formed at the lens 50 and the heat sink 30, it may be possible to eliminate a need for certain connectors to fasten the lens 50 to the heat sink 30, such as bolts, etc. This may enhance productivity during assembly as well as the aesthetics of the lighting apparatus 100. The heat sink 30 and the lens 50 may be coupled without a bolting operation by simply rotating the lens 50 after one end of the lens 50 is inserted into the heat sink 30 via the connector guide portion 57, resulting in enhanced assembly efficiency. Moreover, since the connectors 70 may be hidden from view unlike bolts, the resulting lighting apparatus may have a simplified outer appearance, and enhanced design characteristics.

Hereinafter, a lighting apparatus according to another embodiment is broadly described with reference to FIGS. 5 and 6. Simply for ease of explanation, a description of features which are substantially the same as that previously descried with reference to FIGS. 1 to 4 are omitted hereinbelow.

Figure 5A:
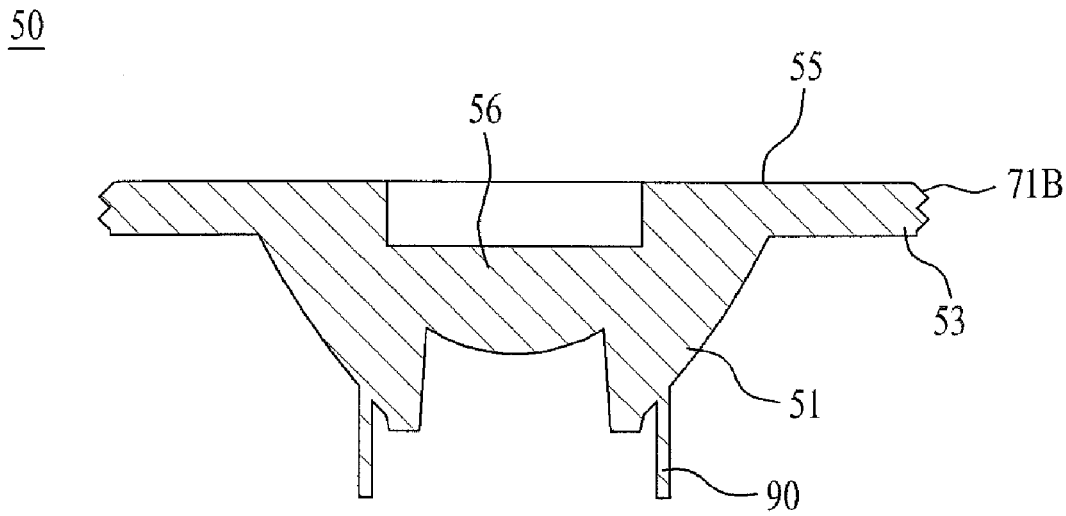
FIGS. 5A and 5B are side sectional views of a lens and a heat sink of a lighting apparatus, respectively, according to another embodiment of the present disclosure.

FIG. 5 is a side sectional view of a lens and a heat sink of a lighting apparatus according to this embodiment. FIG. 5A is a side sectional view of the lens 50 according to this embodiment, and FIG. 3B is a side sectional view of the heat sink 30 according to this embodiment.

Figure 5B:
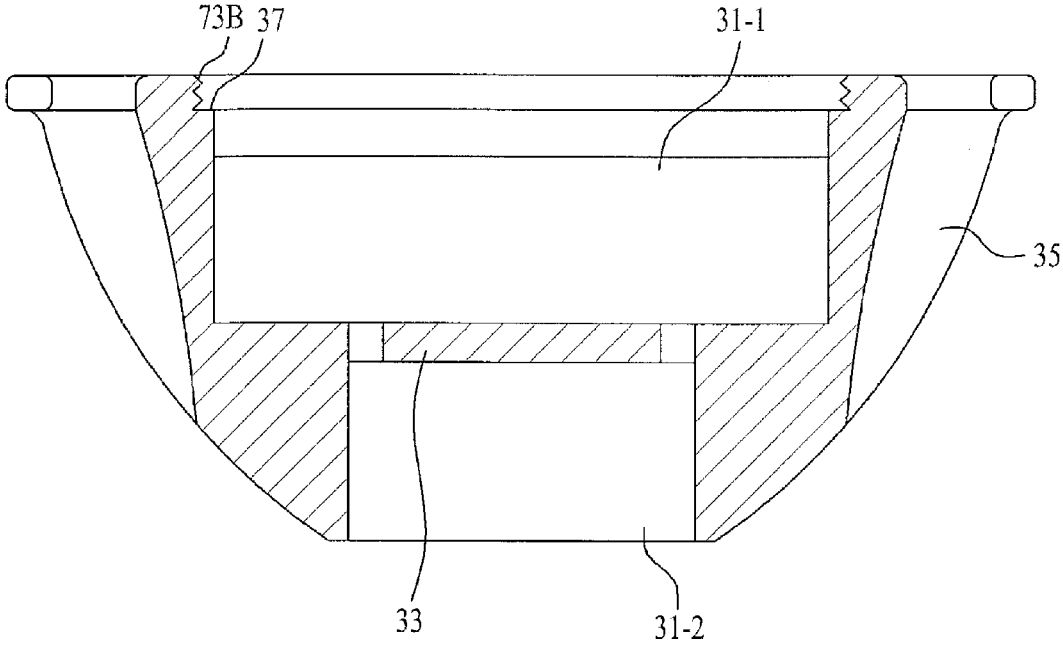

As illustrated in FIG. 5A and 5B, the lens 50 according to the present embodiment as broadly described herein may include a condenser lens 51, a flange 53 provided at an upper end of the condenser lens 51, and a light projection surface 55 provided at an upper end of the flange 53. Fastening structures or connectors 71B and 73B may be formed at an outer circumferential surface of the flange 53 and an inner circumferential surface of a cavity 31 of the heat sink 30, respectively. In this embodiment, the fastening structures or connectors 71B and 73B may be fastening threads.

In this embodiment, unlike the embodiment as shown in FIG. 3, first fastening threads 71B may be formed at the outer circumferential surface of the flange 53 of the lens 50. Thus, the connector guide portion 57 of the embodiment illustrated in FIGS. 1 to 4 may be omitted in the lens 50 of the present embodiment.

In the present embodiment, the lens 50 may further include a limiter 90 to limit a coupling depth of the lens 50 into the heat sink 30. For example, the lens 50 may include the condenser lens 51, the flange 53 provided at the upper end of the condenser lens 51, the light projection surface 55 provided at the upper end of the flange 53, and the limiter 90 provided at a lower portion of the condenser lens 51 to limit a coupling position of the lens unit 50.

To facilitate mass production, for example, the limiter 90 may be positioned to extend from the condenser lens 51. The limiter 90 may have a cylindrical shape and formed throughout the circumference of the lower portion of the condenser lens 51. Alternatively, a plurality of limiters may be provided and spaced apart from one another by a predetermined distance throughout the circumference of the lower portion of the condenser lens 51.

As illustrated in FIG. 5B, the heat sink 30 of the present embodiment may include second fastening threads 73B that correspond to the first fastening threads 71B which may be provided on the outer circumferential surface of the flange 53 of the lens unit 50. For example, unlike the embodiment as illustrated in FIG. 3 in which the second fastening threads 73A of the heat sink 30 may be formed on the inner circumferential surface of the cavity 31 immediately below the stepped portion 37, the first fastening threads 73B of the present embodiment may be formed on the inner circumferential surface of the cavity 31 immediately above the stepped portion 37.

Figure 6:
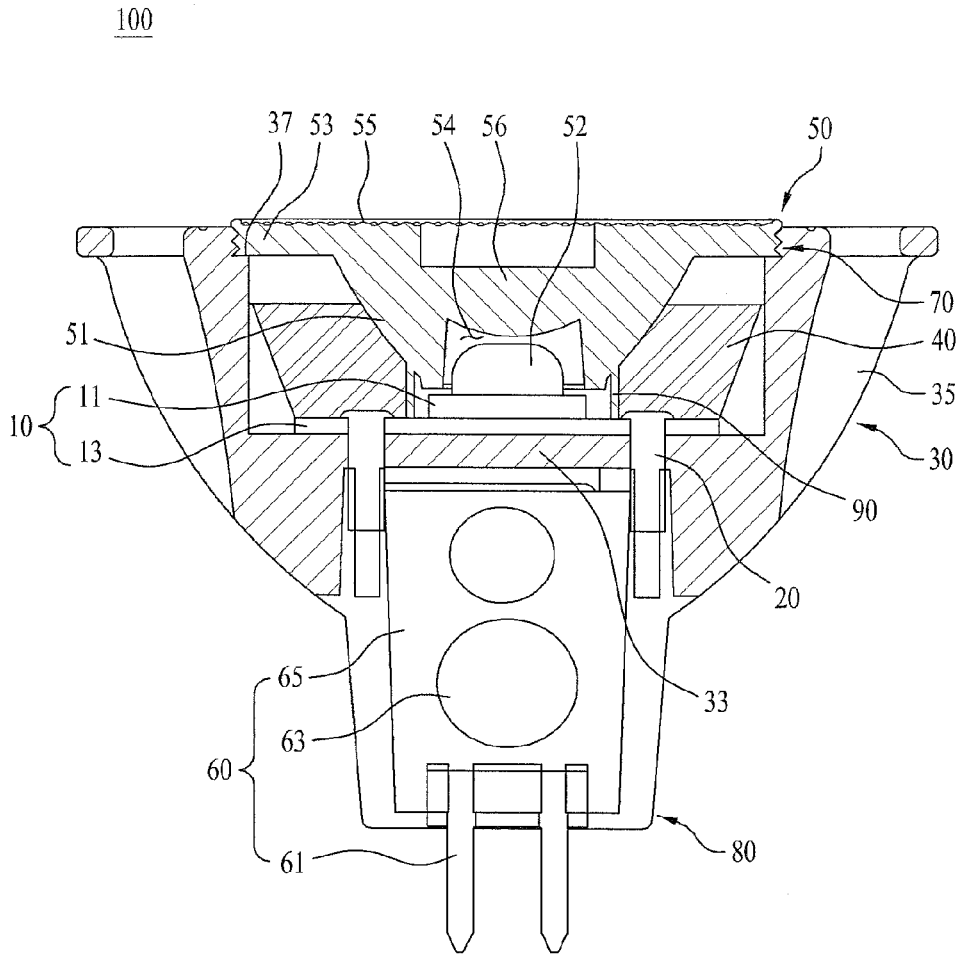
FIG. 6 is a side sectional view of the lens and the heat sink of the lighting apparatus illustrated in FIG. 5.

FIG. 6 is a side sectional view of the lens 50 and the heat sink 30 of the lighting apparatus 100, as shown in FIG. 5. Referring to FIG. 6, the first fastening threads 71B of the lens 50 may be screwed into the second fastening threads 73B of the heat sink 30 to couple the lens 50 to the heat sink 30. Here, the coupling between the lens 50 and the heat sink 30 may be completed when one end of the limiter 90 comes into contact with the printed circuit board 13 of the light source 10. That is, the limiter 90 may limit the coupling position and depth of the lens 50 inside cavity 31. To this end, a length of the limiter 90 may be determined such that one end of the stopper 90 comes into contact with the printed circuit board 13 when the flange 53 of the lens 50 is seated on the stepped portion 37 of the heat sink 30.

Figure 7A:
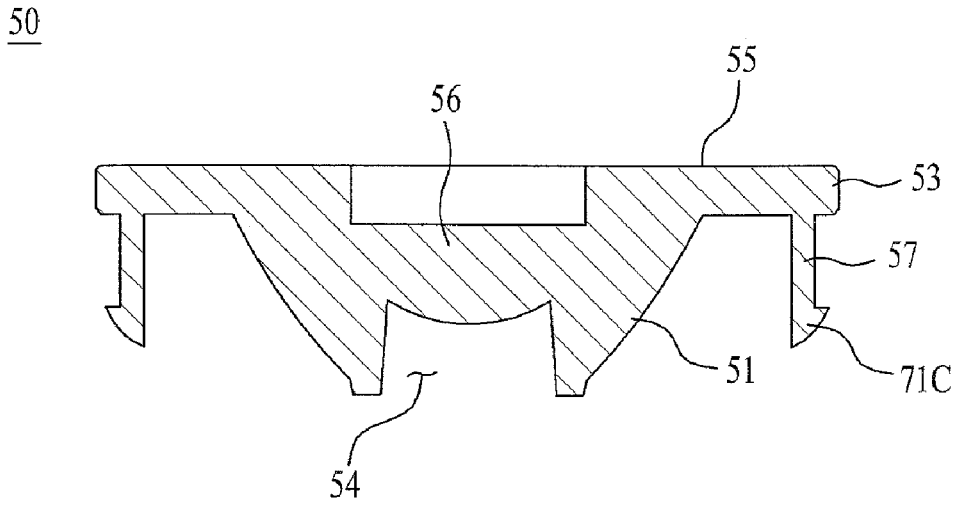
FIG. 7 is a side sectional view of a lens and a heat sink of a lighting apparatus according to another embodiment of the present disclosure.

Hereinafter, a lighting apparatus according to another embodiment is broadly described herein with reference to FIGS. 7 and 8. Simply for ease of explanation, a description of features which are substantially the same as that in previously disclosed embodiments are omitted herein. FIG. 7 is a side sectional view of a lens and a heat sink of the lighting apparatus according to this embodiment. FIG. 7A is a side sectional view of the lens 50 according to this embodiment, and FIG. 7B is a side sectional view of the heat sink according to this embodiment.

Figure 7B:
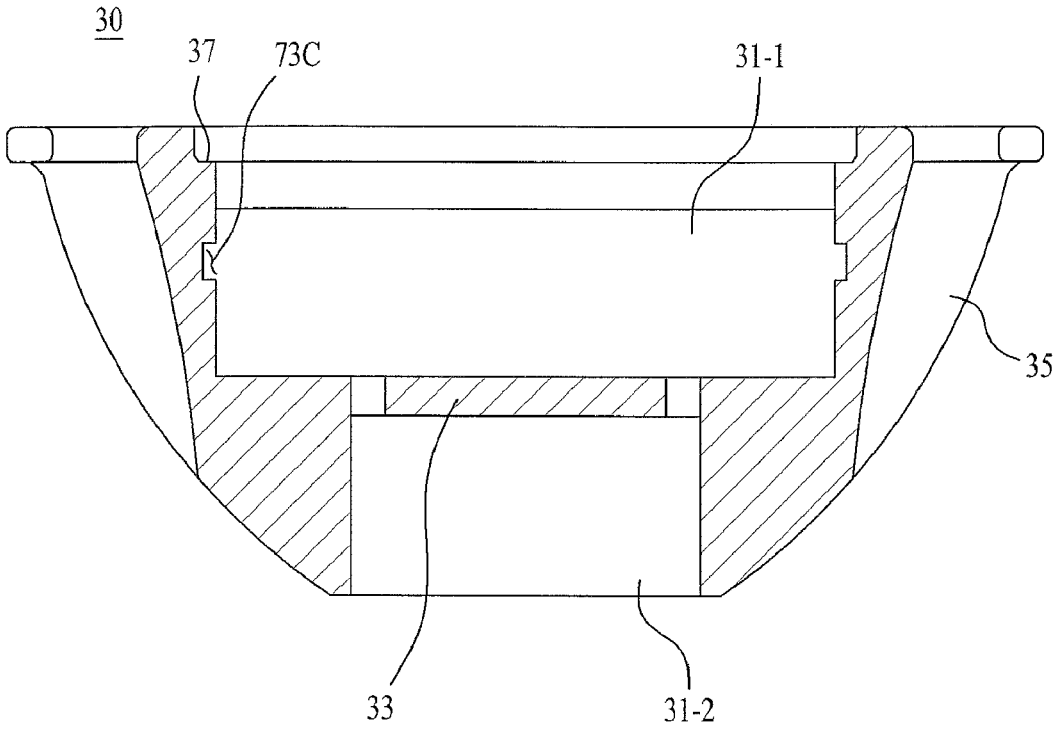

As illustrated in FIGS. 7A and 7B, the fastening structures 70 of the present embodiment as broadly described herein may include a hook 71C formed at a predescribed position on the lens 50 and a coupling recess or notch 730 formed at a predescribed position on the heat sink 30. For example, the lens 50 may include a condenser lens 51, a flange 53 provided at an upper end of the condenser lens 51, a light projection surface 55 provided at an upper end of the flange 53, and a connector guide portion 57 provided on the lower surface of the flange 53 to extend towards the heat sink 30. The hook 71C may be formed at the connector guide portion 57.

Similar to the embodiments as illustrated in FIGS. 1 to 4, the connector guide portion 57 of the lens 50 according to the present embodiment may guide the insertion of the lens 50 into the heat sink 30. However, in this embodiment the connector 71A of the lens 50 may be a hook 710 instead of screw threads as previously disclosed. The hook 71C may protrude outward or downward from a lower end of the connector guide portion 57 and may be formed integrally to the connector guide portion 57.

As illustrated in FIG. 7B, the heat sink 30 may have the notch 73C formed on an inner side surface of the cavity 31. The notch 73C may be positioned to correspond to the hook 71C on the lens 50 to mate with the hook 71C. Moreover, the notch 73C may be recessed on the inner circumferential surface of the cavity 31 of the heat sink 30, in the upper region 31-1 of the cavity 31. The notch 73C and the hook 71C may be positioned to correspond to each other such that the hook 71C is caught by the notch 73C when the flange 53 of the lens 50 is seated on the stepped portion 37 of the heat sink 30.

Moreover, in certain embodiments, the connector guide portion 57 and hook 71C may be formed in a cylindrical shape to extend around the outer circumference of the lens 50 from a bottom surface of the flange 53. The notch 73C may be formed to correspond to the hook 71C and provided around the inner circumferential side surface of the cavity 31. In this embodiment, a gap may be provided along hook 71C to allow hook 71C to flex during insertion into cavity 31. For example, if hook 71C is formed to have a cylindrical shape, it may be difficult to insert the lens 50 into cavity 31. One or more gaps provided on the hook 71C may reduce the force necessary to insert lens 50 into cavity 30.

Figure 8:
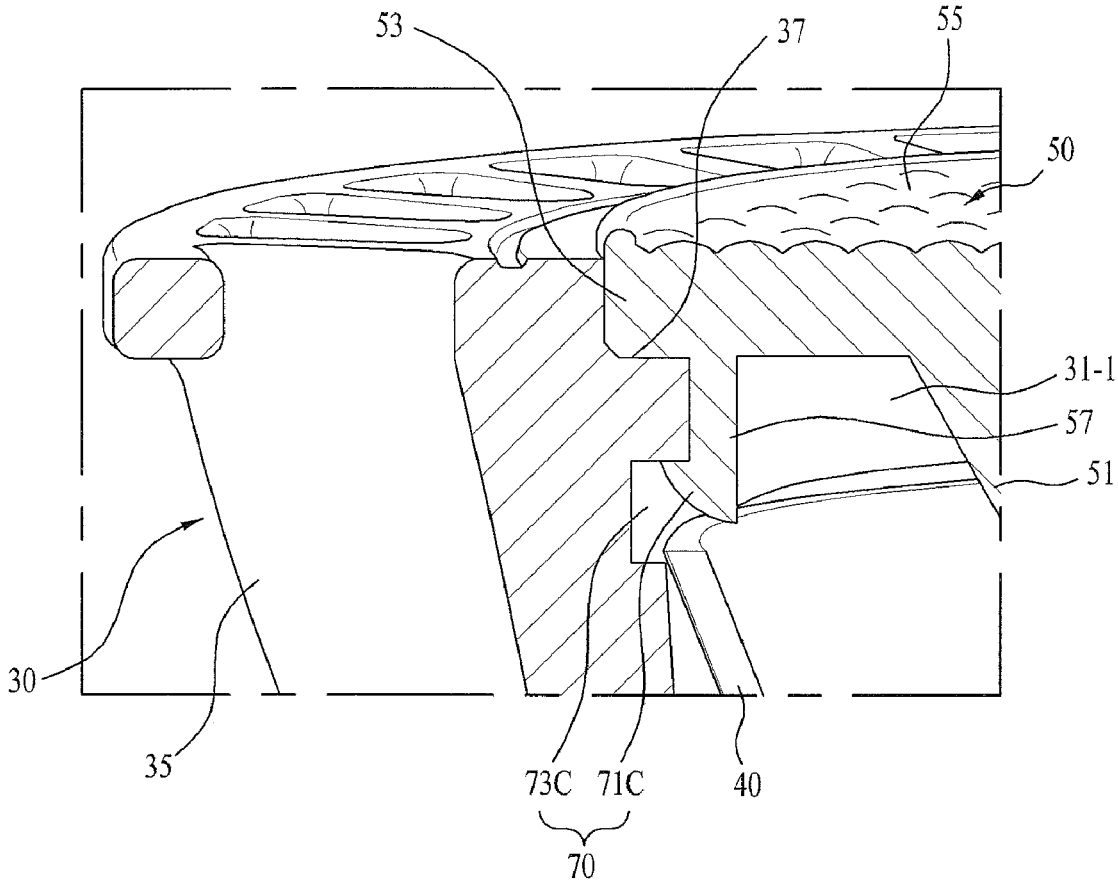
FIG. 8 is an enlarged sectional view of the lens and the heat sink of the lighting apparatus illustrated in FIG. 7.

FIG. 8 is an enlarged sectional view of the lens 50 and the heat sink 30 of the lighting apparatus 100, as shown in FIGS. 7A and 7B. Referring to FIG. 8, the lens 50 in this embodiment may be coupled to the heat sink 30 when the hook 71C is caught by and held in the notch 73C formed in the heat sink 30. Here, the connector guide portion 57 may come into contact with the inner surface of the heat sink 30 to press against the inner surface after the hook 71C has been coupled with the notch 73C. That is, the connector guide portion 57 may have an outer diameter slightly greater than an inner diameter of the heat sink 30 to allow the lens 50 to be firmly fitted inside heat sink 30. Hence, friction between the connector guide portion 57 and the inner side surface of the heat sink 30 may provide a stronger connection.

As described above, the lighting apparatus 100 according to this embodiment may allow the lens 50 to be coupled to the heat sink 30 by simply pushing the lens 50 into the cavity 31 of the heat sink 30, and may result in improved productivity and assembly efficiency. Furthermore, the lighting apparatus may provide enhanced design characteristics because the connectors may be hidden from view.

A lighting apparatus as embodied and broadly described herein may provide coupling between a lens and a heat sink via connectors integrally formed on the lens and the heat sink without a need for additional connectors, such as bolts. The resulting simplified coupling configuration of the lens and the heat sink may facilitate mass production. Furthermore, eliminating connectors, such as bolts, may provide the lighting apparatus with a more aesthetically pleasing appearance.

The present application or patent is directed to a lighting apparatus in which a lens unit and a heat-dissipating member may easily be fastened to each other with a simplified coupling configuration, facilitate mass production, and enhance design characteristics and aesthetics of the lighting apparatus.

A lighting apparatus as embodied and broadly described herein may include a light source unit including a light-emitting element, a heat-dissipating member having a hollow in which the light source unit may be placed and configured to dissipate heat away from the light-emitting element, a lens unit provided at the hollow of the heat-dissipating member, and fastening structures integrally formed at the lens unit and the heat-dissipating member, respectively, for coupling between the lens unit and the heat-dissipating member.

The fastening structures may include screw threads formed at predetermined positions of the lens unit and the heat-dissipating member. Moreover, the lens unit may include a condenser lens, a flange portion provided at an upper end of the condenser lens, a light exit portion provided at an upper end of the flange portion, and a fastening guide portion provided at a lower end of the flange portion, and the fastening structures may be formed at predetermined positions of the fastening guide portion and the heat-dissipating member. The fastening structures may be formed respectively at an outer surface of the fastening guide portion and an inner surface of the hollow. The fastening guide portion may be integrally formed with the flange portion.

The lens unit may include a condenser lens, a flange portion provided at an upper end of the condenser lens, and a light exit portion provided at an upper end of the flange portion, and the fastening structures may be formed respectively at an outer surface of the flange portion and an inner surface of the hollow. In certain embodiments, the lens unit may include a condenser lens, a flange portion provided at an upper end of the condenser lens, a light exit portion provided at an upper end of the flange portion, and a stopper provided at a lower portion of the condenser lens to limit a coupling position of the lens unit. The stopper may extend from the condenser lens. Moreover, the fastening structures may include a hook formed at a predetermined position of the lens unit and a coupling recess indented in a predetermined position of the heat-dissipating member.

The lens unit may include a condenser lens, a flange portion provided at an upper end of the condenser lens, a light exit portion provided at an upper end of the flange portion, and a fastening guide portion provided at a lower end of the flange portion, and the hook may be formed at the fastening guide portion. The coupling recess may be indented in an inner surface of the hollow. The fastening guide portion may be integrally formed with the flange portion. Moreover, the light-emitting element may be a Light Emitting Diode (LED). The light source unit may further include a circuit board on which the light-emitting element is mounted.

The heat-dissipating member may be provided at an outer surface thereof with a plurality of radiator fins radially spaced apart from one another by a predetermined distance. The lighting apparatus may further include a reflection member to reflect light emitted from the light source unit in a predetermined direction. The lighting apparatus may further include an electric unit to drive and control the light source unit upon receiving power from an external source.

In accordance with another aspect of the present disclosure, a lighting apparatus may include a light source unit to emit light, a heat sink thermally coupled to the light source unit, a lens unit to redirect the light emitted from the light source unit to an outside, and fastening structures integrally formed at the lens unit and the heat sink respectively for mechanically coupling between the lens unit and the heat sink.

In accordance with a further aspect of the present disclosure, a lighting apparatus may include a light source unit including at least one light-emitting element and a substrate on which the light-emitting element is mounted, a heat-dissipating member to radiate heat generated by the light source unit placed therein to an outside, a lens unit placed in a partial region of the heat-dissipating member, a first fastening structure integrally formed at the lens unit to couple the lens unit to the heat-dissipating member, and a second fastening structure integrally formed at the heat-dissipating member so as to mesh with the first fastening structure. The first fastening structure may include screw threads formed at a predetermined position of the lens unit, and the second fastening structure may include screw threads formed at a predetermined position of the heat-dissipating member so as to correspond to the first fastening structure.

A lighting apparatus as embodied and broadly disclosed herein may include a light source including at least one light-emitting diode over a substrate on which the light-emitting element is mounted; a heat sink to dissipate heat generated by the light source placed therein, wherein the heat sink includes a first surface having first fastening threads; a lens provided over the light source, wherein the lens includes a first surface having second fastening threads, wherein the first and second fastening threads may mate with each other to fasten the lens to the heat sink.

In this lighting apparatus, the heat sink may include a cavity, and the first fastening threads of the heat sink may be positioned inside the cavity. The lens may include a condenser lens having a flange, and a connector guide portion provided at a lower end of the flange, wherein the second fastening threads may be provided at the connector guide portion. Moreover, the first surface of the heat sink having the first fastening threads may be an inner side surface of the cavity, and the first surface of the lens having the second fastening threads may be an outer surface of the connector guide portion.

In this embodiment, the connector guide portion may be integrally formed with the flange. The lens includes a condenser lens having a flange, and wherein the first surface of the heat sink having the first fastening threads may be an inner side surface of the cavity, and the first surface of the lens having the second fastening threads may be an outer circumferential surface of the flange.

The lens may include a condenser lens that includes a flange, and a limiter provided at a lower portion of the condenser lens, wherein the limiter may be configured to limit a coupling depth of the lens inside the heat sink. The limiter may protrude from a surface of the condenser lens. A top surface of the lens may be coplanar with a top surface of the heat sink, wherein the light source may further include a circuit board on which the light-emitting diode is mounted.

Moreover, the heat sink may include a plurality of radiator fins positioned at an outer surface of the heat sink which are spaced apart from one another by a predetermined distance. The lighting apparatus of this embodiment may further include a reflector to reflect a light emitted from the light source in a predetermined direction, and an electric unit to drive and control the light source upon receiving power from an external source.

In another embodiment, a lighting apparatus may include a light source including at least one light-emitting diode over a substrate on which the light-emitting diode may be mounted; a heat sink to dissipate heat generated by the light source placed therein; a lens provided over the light source, and a hook and notch provided between the heat sink and the lens to couple the lens to the heat sink.

The hook is positioned on the lens and the notch is positioned in the heat sink, wherein the lens may include a condenser lens having a flange, and a connector guide portion may be provided at a lower end of the flange. The hook may be provided at the connector guide portion. The notch is provided on an inner surface of the cavity. Moreover, the connector guide portion is integrally formed with the flange.

In yet another embodiment, a lighting apparatus may include a light source including at least one light-emitting diode over a substrate on which the light-emitting diode is mounted; a heat sink to dissipate heat generated by the light source placed therein, wherein the heat sink includes a recess and a first connector including at least one first protrusion provided on the recess; a lens provided over the light source, wherein the lens has a second connector including at least one second protrusion provided on a surface of the lens, wherein the first and second protrusions contact each other to connect the lens to the heat sink. In this lighting apparatus, the first and second protrusions may be threads.

Examples of a lighting apparatus are disclosed in application Ser. No. 13/049,776, which is hereby incorporated by reference.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting apparatus comprising:

a light source including at least one light-emitting diode over a substrate on which the light-emitting element is mounted;

a heat sink to dissipate heat generated by the light source placed therein, wherein the heat sink includes a first surface having first fastening threads; and a lens provided over the light source, wherein the lens includes a first surface having second fastening threads, wherein the first and second fastening threads mate with each other to fasten the lens to the heat sink, wherein the heat sink includes a cavity, and wherein the first fastening threads of the heat sink are positioned inside the cavity, wherein the lens includes a condenser lens having a flange and a connector guide portion provided at a lower end of the flange, and wherein the second fastening threads are provided at the connector guide portion.

2. The lighting apparatus of claim 1, wherein the first surface of the heat sink having the first fastening threads is an inner side surface of the cavity, and the first surface of the lens having the second fastening threads is an outer surface of the connector guide portion.

3. The lighting apparatus of claim 1, wherein the connector guide portion is integrally formed with the flange.

4. A lighting apparatus comprising:

a light source including at least one light-emitting diode over a substrate on which the light-emitting element is mounted;

a heat sink to dissipate heat generated by the light source placed therein, wherein the heat sink includes a first surface having first fastening threads; and a lens provided over the light source, wherein the lens includes a first surface having second fastening threads, wherein the first and second fastening threads mate with each other to fasten the lens to the heat sink, wherein the heat sink includes a cavity, and wherein the first fastening threads of the heat sink are positioned inside the cavity, wherein the lens includes a condenser lens having a flange, and wherein the first surface of the heat sink having the first fastening threads is an inner side surface of the cavity, and the first surface of the lens having the second fastening threads is an outer circumferential surface of the flange.

5. A lighting apparatus comprising:

a light source including at least one light-emitting diode over a substrate on which the light-emitting element is mounted;

a heat sink to dissipate heat generated by the light source placed therein, wherein the heat sink includes a first surface having first fastening threads; and a lens provided over the light source, wherein the lens includes a first surface having second fastening threads, wherein the first and second fastening threads mate with each other to fasten the lens to the heat sink, and wherein the lens includes a condenser lens that includes a flange, and a limiter provided at a lower portion of the condenser lens, wherein the limiter is configured to limit a coupling depth of the lens inside the heat sink.

6. The lighting apparatus of claim 5, wherein the limiter protrudes from a surface of the condenser lens.

7. The lighting apparatus of claim 1, wherein a top surface of the lens is coplanar with a top surface of the heat sink.

8. The lighting apparatus of claim 1, wherein the light source further includes a circuit board on which the light-emitting diode is mounted.

9. The lighting apparatus of claim 1, wherein the heat sink includes a plurality of radiator fins positioned at an outer surface of the heat sink which are spaced apart from one another by a predetermined distance.

10. The lighting apparatus of claim 1, further comprising a reflector to reflect a light emitted from the light source in a predetermined direction.

11. The lighting apparatus of claim 1, further comprising an electric unit to drive and control the light source upon receiving power from an external source.

* * * * *